US006027136A

United States Patent [19]

Phillips

[11] Patent Number: 6,027,136

[45] Date of Patent: Feb. 22, 2000

[54] SYSTEM FOR PREVENTING TOE-EDGE TRAVEL OF A HI-BACK

[75] Inventor: Frank Phillips, Burlington, Vt.

[73] Assignee: The Burton Corporation, Burlington, Vt.

[21] Appl. No.: 08/780,722

[22] Filed: Jan. 8, 1997

[51] Int. Cl.[7] ..... A63C 9/00

[52] U.S. Cl. ..... 280/618; 280/14.2; 280/633

[58] Field of Search ..... 280/14.2, 11.36, 280/611, 618, 619, 617, 631, 632, 633, 809, 842; 36/117.3, 118.2, 118.3, 118.4, 118.8, 118.9; 441/70

[56] References Cited

U.S. PATENT DOCUMENTS

| | | | |
|---|---|---|---|
| 3,854,743 | 12/1974 | Hansen | 36/118.3 |
| 4,265,034 | 5/1981 | Salomon | 36/121 |
| 4,367,885 | 1/1983 | Ramer | 36/118.4 |
| 4,379,370 | 4/1983 | Balbinot | 36/118.8 |
| 4,575,958 | 3/1986 | Arieh et al. | 36/118.4 |
| 4,601,118 | 7/1986 | Zanatta | 36/118.2 |
| 4,602,443 | 7/1986 | Spademan | 36/118.4 |
| 4,624,063 | 11/1986 | Delery | 36/117 |
| 4,739,563 | 4/1988 | Guggenberger et al. | 36/117 |
| 4,922,633 | 5/1990 | Sartor | 36/117.8 |
| 5,026,087 | 6/1991 | Wulf et al. | 280/613 |
| 5,107,609 | 4/1992 | Sartor | 36/118.8 |
| 5,123,183 | 6/1992 | Paris et al. | 36/117 |
| 5,261,689 | 11/1993 | Carpenter et al. | 280/618 |
| 5,344,179 | 9/1994 | Fritschi et al. | 280/618 |
| 5,356,170 | 10/1994 | Carpenter et al. | 280/618 |
| 5,435,080 | 7/1995 | Meiselman | 36/117 |
| 5,505,477 | 4/1996 | Turner et al. | 280/613 |
| 5,647,148 | 7/1997 | Meiselman | 36/118.2 |
| 5,727,797 | 3/1998 | Bowles | 280/14.2 |

FOREIGN PATENT DOCUMENTS

| | | | |
|---|---|---|---|
| 0 504 768 | 9/1992 | European Pat. Off. | A43B 5/04 |
| 89 02 125 U | 5/1989 | Germany | A63C 9/084 |
| 6-75559 | 10/1994 | Japan . | |
| 9-108398 | 4/1997 | Japan . | |
| 93/14835 | 8/1993 | WIPO | 280/14.2 |
| WO 95/33534 | 12/1995 | WIPO . | |
| WO 97/35494 | 10/1997 | WIPO | A43B 5/04 |

*Primary Examiner*—J. J. Swann
*Assistant Examiner*—Frank Vanaman
*Attorney, Agent, or Firm*—Wolf, Greenfield & Sacks, P.C.

[57] ABSTRACT

A system for preventing toe-edge travel of a hi-back is provided. The system includes a latch, supported by the hi-back, for engaging a snowboard binding base plate. The system can include a forward lean adjuster. When engaged, the latch prevents travel of the hi-back relative to the snowboard binding base plate, thereby increasing the responsiveness of the snowboard to rider movements. The latch may be engaged in a lateral rotational position of the hi-back.

20 Claims, 6 Drawing Sheets

SYSTEM FOR PREVENTING TOE-EDGE TRAVEL OF A HI-BACK

FIELD OF THE INVENTION

The invention relates to a system for preventing toe-edge travel of a hi-back.

BACKGROUND OF THE INVENTION

A snowboard rider controls the board by flexing and moving her legs relative to the toe or heel edge. To help translate the rider's movements, a snowboard binding oftentimes is provided with an upright member called a hi-back, illustrated in FIG. 1, which includes a heel cup that receives the heel of the snowboard boot. Flexing her legs forward will create an upward force on the heel cup which helps influence the board to shift onto the toe edge and as the rider leans forward the force is transmitted along the hi-back and binding to the board to complete the turn. Similarly, flexing her legs rearward against the hi-back puts the board on the heel side edge and a corresponding transfer in weight and balance finishes the heel side turn.

To accommodate the legs angled forward snowboarding stance, the hi-back typically is inclined relative to the board, in a position referred to as the "forward lean". A forward lean adjuster, such as a slidable block or other incrementally adjustable member, typically is provided on the hi-back to allow the rider to selectively regulate the angle of the hi-back for comfort and control. The variable position block acts as a stop against a heel hoop of the binding base plate, limiting the rearward pivoting of the hi-back beyond the desired forward lean setting. On the other hand, the forward lean adjusting block does not prevent the hi-back from traveling away from the heel hoop, such as when the board is placed on the toe edge. Migration of the hi-back out of contact with the heel hoop, sometimes referred to as toe-edge travel, may decrease the translation of rider motion to the board as compared to when the hi-back is in abutting contact with the base plate, such as when the forward lean stop block is flush against the heel hoop.

It is known to provide a hi-back 10 with a flat rectangular bail 12 that seats within a pair of centrally located vertical slots 14 on the heel hoop of the binding base plate to prevent hi-back migration, as illustrated in FIG. 1. The prior art arrangement, however, does not accommodate lateral rotation of the hi-back. As disclosed in U.S. Pat. No. 5,356,190, assigned to The Burton Corporation, also the assignee of the present application, snowboard bindings oftentimes are positioned at an angle to the axis of the board (such as 45°, for example) which may reduce heel side turning response since the turning force is not transmitted perpendicularly to the edge of the board. To compensate for the bindings stance, the '190 patent discloses an arrangement for laterally rotating the hi-back independent of the binding plate so that it presents a surface relatively parallel to the edge of the board, improving response particularly on heel side turns.

SUMMARY OF THE INVENTION

The present invention is a system for preventing toe-edge travel of a hi-back which may be mounted for lateral rotation to a snowboard binding and selectively arranged in a predetermined forward lean. The stabilized hi-back enhances the interaction of snowboard, boot and binding, facilitating a rider's anticipation, initiation and completion of heel-side and toe-side turns as well as the rider's sense and feel for the snowboard. With the hi-back maintained in a constant position, the force generated by flexing of the rider's legs is quickly translated to the board particularly when shifting from a toe edge to a heel edge, increasing responsiveness of the snowboard to a rider's movements. In the inventive arrangement, toggling or travel of the hi-back between toe and heel edges is precluded. Consequently, the hi-back is already in the original forward lean position when the rider begins to shift from the toe to the heel edge, providing efficient translation of the rider's movements along the hi-back, base plate and board. Clamping the hi-back to the base plate may enhance the fit of the heel hoop and the hi-back, potentially yielding increased comfort and control.

The system includes a latch with a curved, preferably upturned, locking portion for engaging the snowboard binding base plate and a support or body constructed and arranged for supporting the latch on the snowboard hi-back. The upturned or hook configuration of the locking tip allows the latch to connect with the heel hoop of the binding plate regardless of the lateral rotation of the hi-back, allowing the rider to arrange the hi-back parallel to the edge of the board for quick response in heelside turns while still securing the hi-back against toe side travel out of a pre-set forward lean. The latch may include a bail and may be Y-shaped, T-shaped, or assume another shape or construction that is sufficient to clamp the hi-back to the binding base plate. Preferably, the support for the latch includes a forward lean adjuster such as a stop block which is modified to include the latch. A handle, such as a lever, may be provided to facilitate moving the locking tip of the latch into and out of engagement with the binding base plate.

The present invention also includes a hi-back constructed and arranged with a latch for restraining the hi-back from migrating out of the pre-set forward lean. The hi-back may include lateral arms for mounting the hi-back to a snowboard binding base plate for toe to heel edge pivoting as well as lateral rotation. The latch, preferably in combination with a forward lean adjuster, may be flush mounted in a recess in an upright body portion of the hi-back to provide a reduced profile, avoiding heel side drag. A shin strap may be mounted to the hi-back to increase medial flex and carving control.

The present invention also includes a snowboard binding plate that is especially configured for engagement with a latch having a locking tip. The plate includes a base having a toe end and a heel end for receiving a snowboard boot and a heel hoop which mounts a hi-back for lateral rotation and toe to heel end pivoting. The heel hoop is adapted to securely receive the upturned end of the latch, preventing migration of the hi-back during toe side turns. A groove preferably extends laterally and continuously from a central region of the heel hoop so that the latch may be engageable with the heel hoop throughout the full range of lateral rotation of the hi-back. The groove may be provided in an underside of the heel hoop or in a flange that extends therefrom.

The present invention also includes an assembly of a hi-back and a snowboard binding plate, the hi-back having a latch with a curved, preferably upturned, locking portion mounted on a forward lean adjuster, such as a stop block. The hi-back is pivotally and rotatably mounted to a snowboard binding plate and may be placed in a selected forward lean by manipulation of the forward lean adjuster. A heel hoop in the plate may include a groove that is adapted to securely receive the locking tip of the latch, clamping the loop between the locking tip and the contacting face of the stop block so that the hi-back is precluded from shifting out of the forward lean setting as the board is turned on the toe edge.

The present invention further includes a hi-back constructed and mounted to a base plate for lateral rotation between a first position and a second position and which is engageable to said base plate in said first position and said second position to prevent toe-edge travel of the hi-back.

It is an object of the invention to provide a system for preventing toe-edge travel of a hi-back.

It is another object of the invention to provide a hi-back having a system for preventing toe-edge travel of the hi-back which is operational in selective lateral rotational position of the hi-back.

It is a further object of the invention to provide a snowboard binding which permits a snowboard rider to exercise optimal control of both toe-side and heel-side turning regardless of the preferred stance of the rider.

It is yet another object of the invention to provide a snowboard binding system which provides the rider with a secure soft boot/binding fit.

It is still another object of the invention to provide an improved snowboard binding base plate which is securely engageable to a hi-back in selected lateral rotational positions of the hi-back.

Other objects and features of the present invention will become apparent from the following detailed description when taken in connection with the accompanying drawings. It is to be understood that the drawings are designed for the purpose of illustration only and are not intended as a definition of the limits of the invention.

BRIEF DESCRIPTION OF THE DRAWINGS

The foregoing and other objects and advantages of the invention may be appreciated more fully from the following drawings.

FIG. 5 also depicts the engagement of a rack of spaced channels with support rods of the hi-back for forward lean adjustment.

DETAILED DESCRIPTION OF THE INVENTION

Figure 1A:
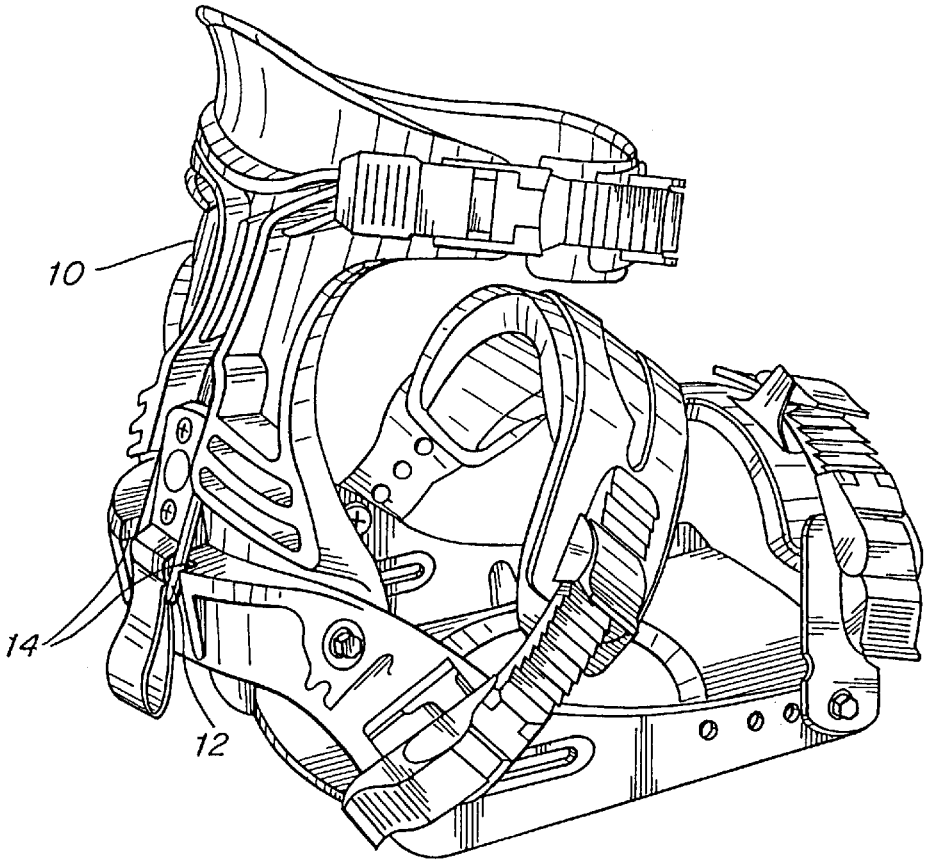
Fig. 1A (PRIOR ART)
FIGS. 1A–B are illustrations of a prior art arrangement of a hi-back, with FIG. 1A depicting a hi-back with a flat rectangular bail that seats within a pair of centrally located vertical slots on the heel hoop of the binding base plate and FIG. 1B depicting a portion of the rectangular bail which engages the slots.
Figure 1B:
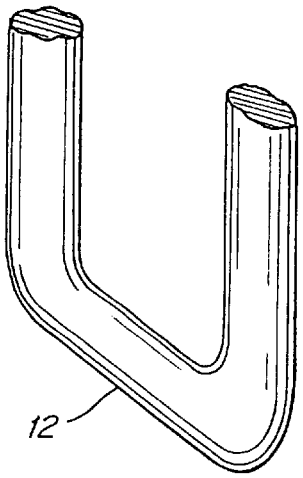
Fig. 1B (PRIOR ART)
Figure 2A:
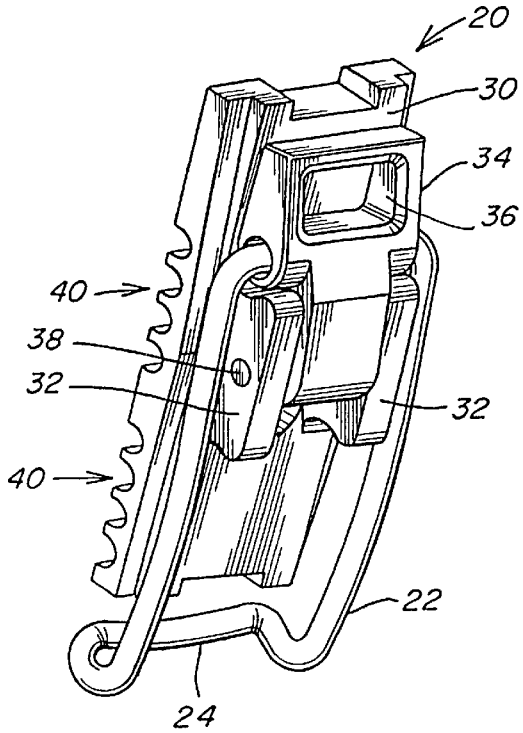
FIGS. 2A–B illustrate a system for preventing toe-edge travel of a hi-back, showing the latch as a bail with a curved portion and, in FIG. 2A, the latch is in the locked position and, in FIG. 2B, the latch is in the open position.
Figure 2B:
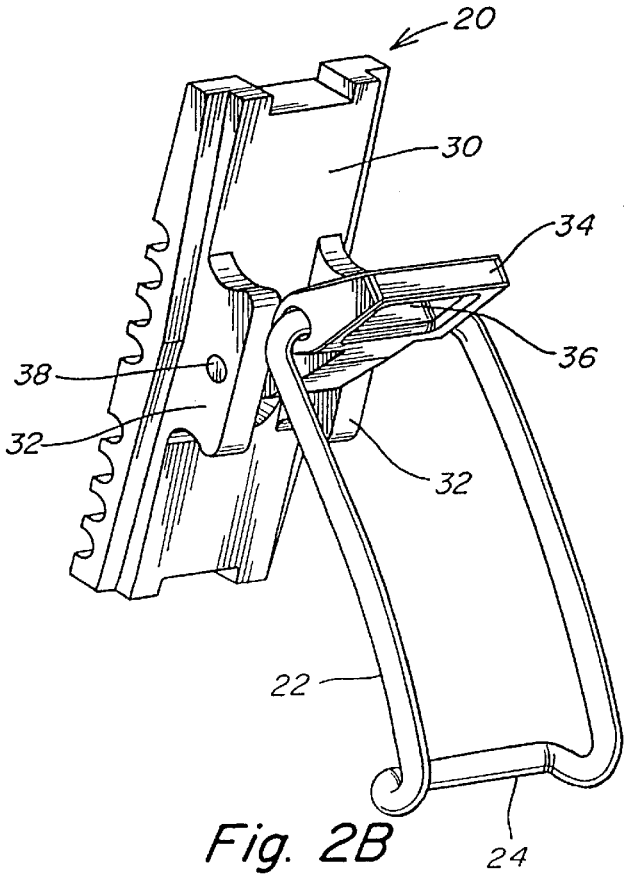

A system 20 for preventing travel of a hi-back towards the toe edge of a board is illustrated in FIGS. 2A and 2B and may include a latch 22 having a curved, preferably upturned, end portion 24 for locking to a binding base plate and a support for mounting the latch to the hi-back. The latch illustrated in FIG. 3 has a Y-shaped configuration with a pair of support arms connecting to a central locking body that terminates in a hook for engaging with the heel hoop of the base plate. Other latch configurations, such as a T-shape or a C-shape for example, may be employed as would be apparent to one of skill in the art. The angle of the locking tip may vary so long as the curvature is sufficient to secure the latch to the heel hoop. The latch may be made of impact resistant, durable and strong material such as plastic, metal or metal wire bail and, preferably, is formed from light, high strength aluminum. The latch may be prepared by any suitable manufacturing process such as, for example, extrusion, drawing, forging, casting or machining.

The latch support in its simplest form is a frame that supports the latch so that it may be engaged to the base plate. As shown in FIGS. 2A and 2B, the latch support is an elongated panel 30 which may have one or more through holes for accepting a fastener, such as a screw, for securing the panel to the hi-back. Other mechanisms for joining the hi-back and panel are contemplated as should be recognized by one of skill in the art. Optionally, the panel is mounted on a plate of stamped steel affixed to or formed integrally within the high-back. The panel preferably is manufactured of polycarbonate, but can be made of other materials such as nylon 6/6 or aluminum.

Preferably, the panel includes a mount, such as a pair of opposed projections 32, for pivotally supporting a handle, such as a lever 34, that controls the position of the latch, facilitating handling of the latch and engagement and disengagement of the locking tip with the base plate by the user. An over center configuration of the lever also is illustrated in FIGS. 2A and 2B, wherein the lever is provided with shoulders that seat within complementary recesses on the mount when the lever is in the upstanding or locked position. Other mount configurations which permit locking of the handle are contemplated. An opening 36 in the lever facilitates grasping by a user and also provides a catch for connecting a leash that may be pulled by the rider to disengage the locking tip. The latch is mounted to the lever by a rod 38 which passes through a first through hole in one of the pair of support arms, a through hole in a lever and a second through hole in a second support arm. The rod may have a threaded portion which engages a threaded portion of one or more of the through holes. Other arrangements for mounting the latch to the lever are contemplated. The handle preferably is manufactured of polycarbonate, but can be made of other materials such as nylon 6/6 or aluminum. A leash (not shown) preferably is formed from a loop of stitched nylon webbing but also can be formed of nylon cord, flexible wire or as a flexible injection molded "T" shape.

Figure 5:
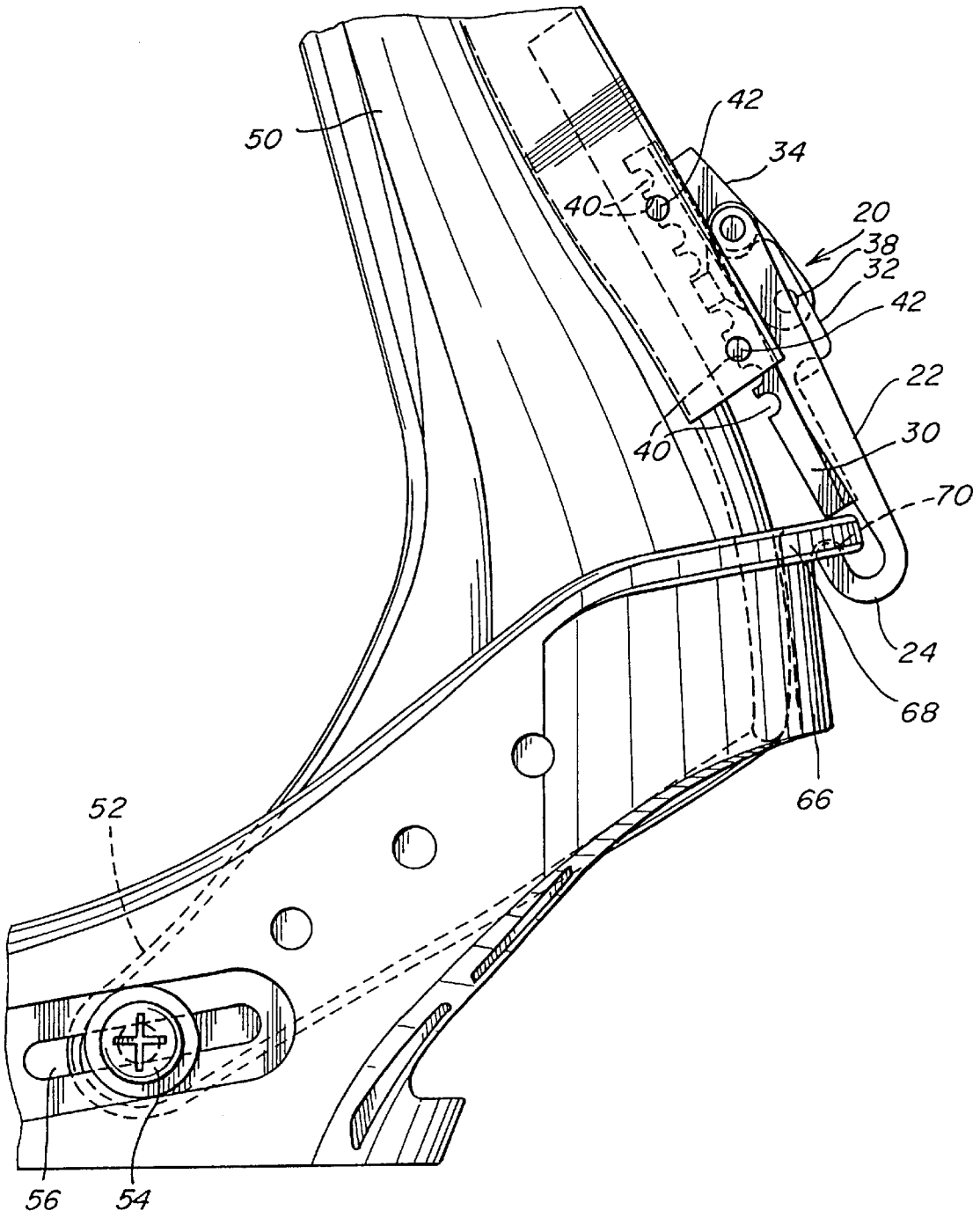
FIG. 5 is an illustration of a side view of the snowboard binding as in FIG. 3, depicting the engagement of the latch with a groove of a heel hoop flange.
Figure 6:
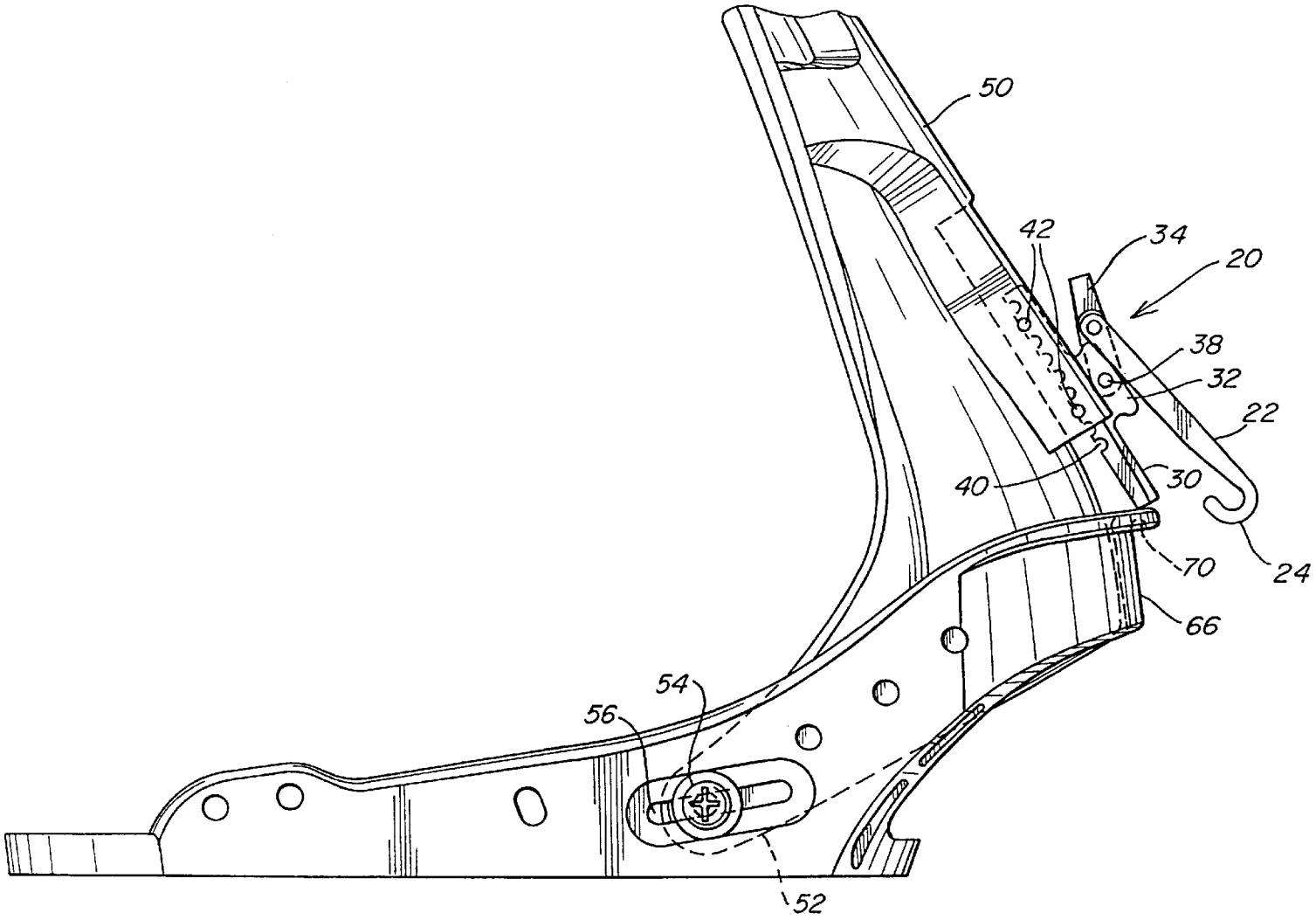
FIG. 6 is an illustration of a side view of the snowboard binding as in FIG. 4, depicting the latch in the open (unlocked) position.

The latch support may be fixedly positioned on the hi-back but preferably is mounted for movement along the hi-back. Preferably, the latch support is a forward lean adjuster, such as the stop block-type panel 30 illustrated in FIGS. 2A and 2B, or other arrangement for varying the angle of the hi-back. The forward lean adjuster may include a rack of spaced channels 40, such as grooves or indentations, that are adapted to engage one or more complementary support rods 42, as shown in FIG. 5, or other support structure on the hi-back. The forward lean of the hi-back may be selectively varied in predetermined increments as the forward lean adjuster is raised or lowered relative to the support rods. For example, the forward lean may change in 5° increments from one channel to the next. Asymmetrically arranging the grooves on the block, as illustrated, provides a second, different range of forward lean when the block is removed from the hi-back, flipped over, and remounted to the hi-back. In the latter mode, the lever may be removed by popping out the pin which fixes the lever. After remounting the lever in the proper orientation, the pin may be refastened. Other increments of forward lean, and arrangements for moving the block relative to the hi-back, such as complementary toothed surfaces, may be employed as would be apparent to one of skill in the art.

Figure 3:
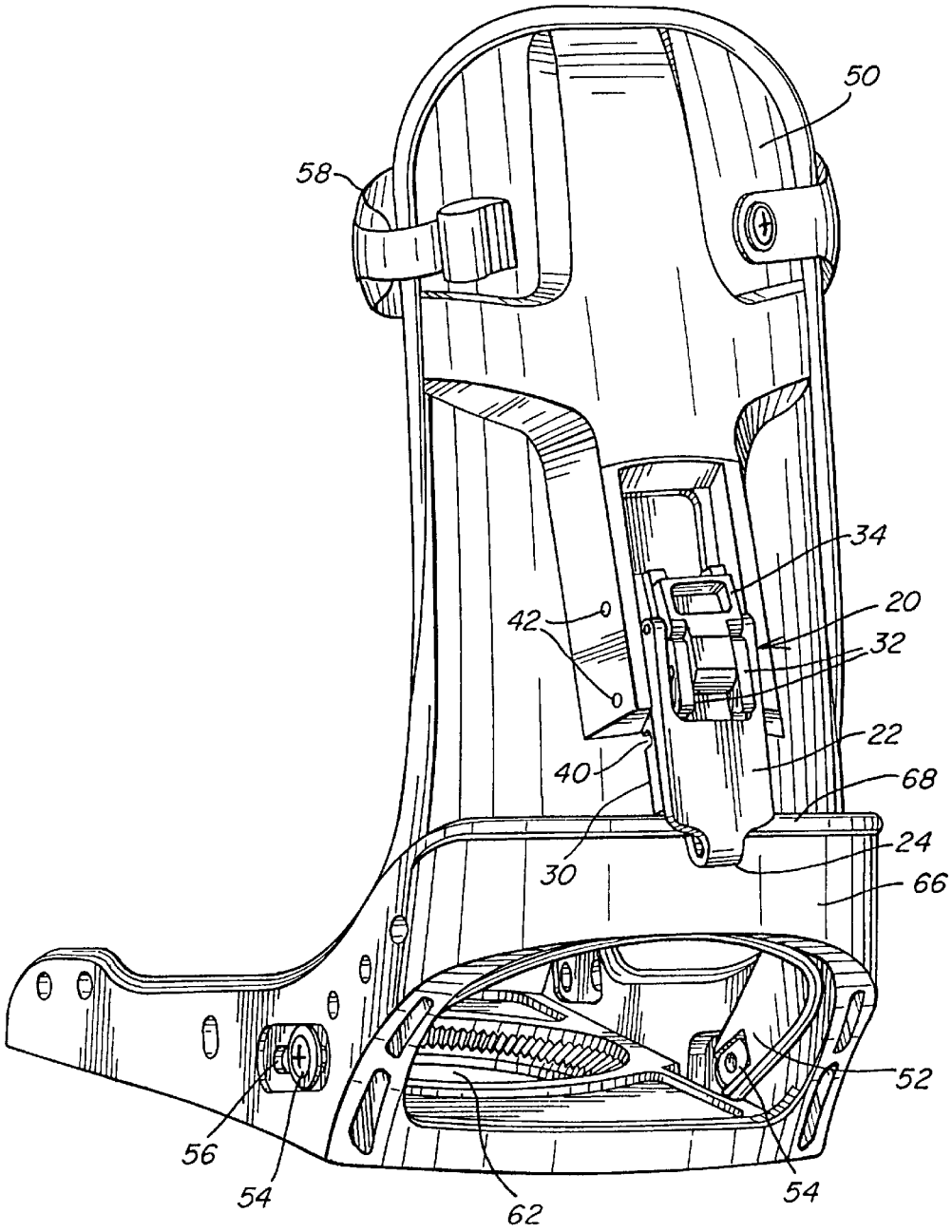
FIG. 3 is an illustration of a snowboard binding including a base plate, a hi-back, and a system for preventing toe-edge travel of a hi-back, depicting the latch in the locked position.

A hi-back including a toe edge travel restraint is illustrated in FIG. 3 and may include an upright hi-back body 50 having a recess for flush mounting the combined forward lean adjuster and latch to provide a reduced profile which is less likely to drag in the snow when the board is on heel edge. Lateral arms 52 or wings of the hi-back may be connected by fasteners 54 or the like to the base plate. When mounted to elongated slots 56 in sidewalls of the base plate, the ends of the arms may be offset from one another, that is with one end closer to the toe side and the other end closer to the heel side, as occurs when the hi-back has been laterally rotated relative to a vertical axis extending through the binding plate. The hi-back preferably is formed by injection molding a high impact plastic such as polycarbonate, surlyn, polyolefin, polyurethane or polyethylene. A shin strap 58 may be attached to the hi-back, providing additional board control. The hi-back may be provided with a heel cup or other shape that conforms with the shape of the boot to increase transmission of rider induced forces to the board.

Figure 4:
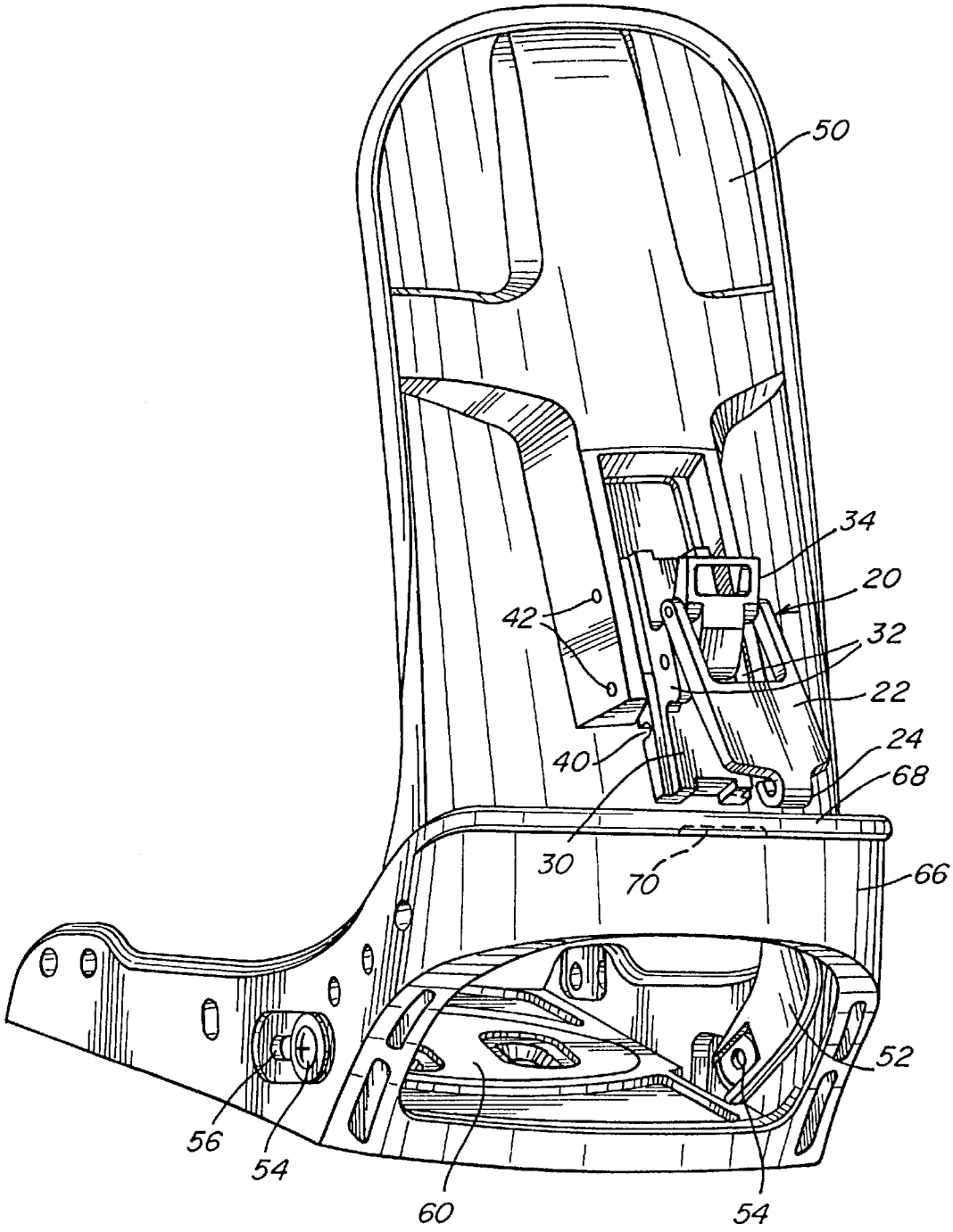
FIG. 4 is an illustration of the snowboard binding as in FIG. 3, depicting the latch in the open (unlocked) position.

A binding plate may include sidewalls, a toe end and a heel end and is constructed and arranged to receive a snowboard boot. The binding plate may be fixed to a snowboard by securing fasteners through holes in the base, such as openings in a hold down disc 60 that is mated with an aperture 62 in the base plate (see FIGS. 3 and 4). The binding plate preferably is formed of polycarbonate, nylon or aluminum. As shown in FIG. 5, a heel hoop 66 extends around the end of the plate and may include a flange or depending wall 68 that defines a groove 70 for secure engagement with the locking tip of the latch. Preferably, the groove extends along the complete curvature of the heel hoop or at least that portion of the heel hoop about which the hi-back portion mounting the latch may be laterally rotated. The heel hoop region containing the groove may be free of support structure such as a gusset that could interfere with engagement of the latch to the base plate. Consequently, the heel hoop may provide an uninterrupted portion, preferably defining a groove, extending from a central region thereof that allows the latch to be clamped to the baseplate after the hi-back has been laterally rotated.

The system for preventing toe-edge travel of a hi-back provides increased responsiveness of the snowboard/binding/boot combination to a rider's movements. This may be illustrated by a description of the use of the system. Typically, the rider places her boot in the snowboard binding base plate and secures the boot by fastening one or more straps, such as an ankle strap and a toe strap. The bindings may be angled relative to the toe side-heel side axis of the snowboard, in which case the rider can laterally rotate the hi-back to bring it parallel to the heel side edge of the snowboard before placing her boot in the binding. The rider can then select the preferred angle of forward lean by adjusting the forward lean adjuster. The forward lean may also be preset by the rider prior to securing the boot to the binding. When using the embodiment of the system shown in the Figures, the rider can fasten the hi-back to the base plate by moving the lever which controls the latch position from the open position shown in FIG. 2B to the locked position shown in FIG. 2A to engage the latch to the base plate.

Once the base plate and hi-back are engaged by clamping the heel hoop of the base plate between the forward lean adjuster and the latch, toe-edge travel of the hi-back is prevented. The rider now can begin snowboarding. Starting from a snowboard flat on a snow surface, the rider can initiate a toe-side turn by flexing her legs forward. This movement creates an upward force on the heel cup of the hi-back and heel hoop of the base plate in which the heel of the rider's boot fits. Because the hi-back is locked in position, the toe-side turning force is rapidly translated into movement of the snowboard onto its toe-side edge. As the turn continues, the rider drives her knees into the turn. This force is also translated to turning force efficiently because the locked hi-back functions to transmit the force to the snowboard. The same principle is true when the rider transfers weight from the lead foot to the trailing foot to finish the toe-side turn. As the rider unweights to initiate the heel-side turn, simultaneously flexing her legs toward the heel-side edge of the board, there is no delay in binding response due to hi-back slop because the locked high-back does not travel before engaging the base plate to transmit turning force. Once the snowboard is on its heel-side edge, the rider drives his or her knees and transfers weight in the manner described above to complete the heel-side turn.

Thus the present invention provides a system for preventing toe-edge travel of a hi-back which increases snowboard binding performance. The system includes a latch supported by the hi-back which engages the binding base plate thereby optimizing both comfort and performance of the rider. Optionally, other components are provided to adjust the forward lean of a hi-back and to facilitate the movement of the latch into and out of engagement with the base plate. The base plate is constructed and arranged to receive the latch, by providing a surface such as a heel hoop lip including a groove for engaging the latch.

It should be understood that the foregoing description of the invention is intended merely to be illustrative thereof and that other equivalents, embodiments, and modifications of the invention may be apparent to those skilled in the art. Such equivalents are intended to be covered by the following claims.

I claim:

1. A system for preventing toe-edge travel of a hi-back that is mountable to a snowboard binding base plate, comprising:

a forward lean adjuster constructed and arranged for mounting to the hi-back and which is adjustable for setting a variable forward lean of the hi-back; and a latch supported by said forward lean adjuster and having a locking portion with a locking segment extending in a direction toward the hi-back, the locking portion being constructed and arranged for releasably engaging the snowboard binding base plate to prevent toe-edge pivoting of the hi-back, wherein said latch includes a handle that is movable between a first position and a second position, said latch being movable between a locked position in which said locking portion is engageable to the snowboard binding base plate and an unlocked position in which said locking portion is disengageable from the snowboard binding base plate in response to movement of said handle between said first position and said second position, respectively.

2. The system recited in claim 1, wherein said handle is a lever.

3. The system recited in claim 2, wherein said lever is an over-center lever.

4. The system recited in claim 1, further including a mount for said handle, said mount including a first seat for supporting said handle in said first position when mounted in a first orientation.

5. The system recited in claim 4, wherein said handle is removable from said mount, and remountable in a second orientation, said mount including a second seat for supporting said handle in said first position when mounted in said second orientation.

6. A system for preventing toe-edge travel of a hi-back that is mountable to a snowboard binding base plate, comprising:

a forward lean adjuster constructed and arranged for mounting to the hi-back and which is adjustable for setting a variable forward lean of the hi-back; and a latch supported by said forward lean adjuster and having a locking portion with a locking segment extending in a direction toward the hi-back, the locking portion being constructed and arranged for releasably engaging the snowboard binding base plate to prevent toe-edge pivoting of the hi-back, wherein said forward lean adjuster may be supported by the hi-back in a first orientation to provide a first range of forward lean and in a second orientation to provide a second range of forward lean and wherein said latch is supported by said forward lean adjuster in a first orientation and is releasably engageable to the snowboard binding base plate, and is removable from said forward lean adjuster and remountable in a second orientation that is releasably engageable to the snowboard binding base plate.

7. A system for preventing toe-edge travel of a hi-back, the system comprising:

a snowboard binding base plate having a toe end, a heel end, and a heel hoop;

a hi-back mounted to said snowboard binding base plate for toe end to heel end pivoting and for lateral rotation relative to an axis substantially normal to said snowboard binding base plate between a first lateral position and a second lateral position;

a forward lean adjuster mounted to said hi-back, said forward lean adjuster being adjustable for setting a variable forward lean of said hi-back; and a latch supported by said forward lean adjuster and having a curved locking portion constructed and arranged for releasably engaging said heel hoop to prevent toe-edge pivoting of said hi-back at said first lateral position and at said second lateral position.

8. The system recited in claim 7, wherein at least a portion of heel hoop includes an uninterrupted groove extending laterally from a central portion of said heel hoop which is adapted to receive said locking portion.

9. A hi-back that is mountable to a snowboard binding base plate, comprising:

an upright hi-back body constructed and arranged for toe-edge pivoting and for lateral rotation relative to an axis substantially normal to the snowboard binding base plate between a first lateral position and a second lateral position; and a latch supported by said upright hi-back body and having an upturned locking portion constructed and arranged for releasably engaging the snowboard binding base plate to prevent toe-edge pivoting of said hi-back body when laterally rotated to said first position and said second position.

10. The hi-back recited in claim 9, further including a forward lean adjuster supported by the upright body for incrementally adjusting the forward lean of said upright body relative to the snowboard binding base plate.

11. The hi-back recited in claim 10, wherein said latch is supported by said forward lean adjuster.

12. The hi-back recited in claim 9 further including a shin strap.

13. The hi-back recited in claim 9, in combination with the snowboard binding base plate, wherein the hi-back is mounted to the snowboard binding base plate.

14. A snowboard binding plate for mounting a hi-back that includes a latch with a locking portion, said snowboard binding plate comprising:

a base, having a heel-end and a toe-end, that is constructed and arranged for receiving a snowboard boot;

a heel hoop extending from said base and having a central region thereof, said base constructed and arranged for mounting the hi-back for lateral rotation between a first position in which the hi-back is registered with said central region and a second position, said heel hoop having an uninterrupted portion extending laterally from said central region that is adapted to securely receive the locking portion when the hi-back is mounted to said base and has been rotated between said first position and said second position.

15. The snowboard binding plate recited in claim 14, wherein said uninterrupted portion includes a continuous groove.

16. The snowboard binding plate recited in claim 15, wherein said continuous groove extends along a bottom of said heel hoop.

17. The snowboard binding plate recited in claim 14, wherein said uninterrupted portion is gusset-free.

18. The snowboard binding plate recited in claim 14, in combination with the hi-back, wherein the hi-back is mounted to said base that is pivotable towards said toe and heel-end and is laterally rotatable and includes a latch having a locking portion constructed and arranged for engaging said heel hoop.

19. The snowboard binding plate recited in claim 18, wherein said hi-back further includes a shin strap.

20. A system for preventing toe-edge travel of a hi-back, comprising:

a hi-back having an upright body; and a base plate constructed and arranged to receive a snowboard boot;

wherein said hi-back is constructed and mounted to said base plate for lateral rotation relative to an axis substantially normal to the base plate between a first position and a second position and is engageable to said base plate in said first position and said second position to prevent toe-edge travel of the hi-back.

* * * * *